United States Patent [19]

Pearson et al.

[11] Patent Number: 4,857,076

[45] Date of Patent: Aug. 15, 1989

[54] ANNULAR NOZZLE

[75] Inventors: Stanley R. Pearson; Douglas D. Merrick, both of Baton Rouge; William P. White, Greenwell Springs; Charles W. Lipp, Baton Rouge, all of La.

[73] Assignee: The Dow Chemical Company, Midland, Mich.

[21] Appl. No.: 29,296

[22] Filed: Mar. 23, 1987

Related U.S. Application Data

[63] Continuation-in-part of Ser. No. 723,767, Apr. 16, 1985, abandoned.

[51] Int. Cl.[4] ..... C10J 3/48

[52] U.S. Cl. ..... 48/86 R; 48/DIG. 7; 239/132.3; 239/427.3; 239/428

[58] Field of Search ..... 239/427.3, 182.3, 428, 239/DIG. 19; 48/197 R, 206, DIG. 7, 215, 86 R, 63, 77, 73, DIG. 7

[56] References Cited

U.S. PATENT DOCUMENTS 4,364,744 12/1982 Crouch et al. ..... 48/86 R
4,443,228 4/1984 Schlinger ..... 48/86 R
4,443,230 4/1984 Stellaccio ..... 48/197 R

FOREIGN PATENT DOCUMENTS 632655 10/1927 France ..... 239/591

*Primary Examiner*—Peter Kratz

[57] ABSTRACT

An improved burner nozzle and process for making a synthetic or fuel gas mixture containing hydrogen and carbon monoxide by the partial oxidation, in a free-flowing hollow reactor, of a slurry of solid carbonaceous fuel in a liquid carrier admixed with a gas containing free oxygen. The nozzle may also be used in other applications where nozzles are required to handle slurries having a high concentration of finely-divided solids that must be uniformly admixed with a gas, as for example, in the aeration or incineration processes of a waste disposal plant. The nozzle and process include enveloping of an annular slurry stream between a central layer and an annular layer of high velocity gas, impinging the annular slurry stream on a downstream nozzle diffuser where a zone of high shear forces produce a uniform atomized admixture of solids, liquids and gases, and then transporting the admixture through an exit orifice at an accelerated velocity to further atomize the admixture.

6 Claims, 3 Drawing Sheets

ANNULAR NOZZLE

CROSS REFERENCE TO RELATED APPLICATIONS

This Application is a continuation-in-part of application, Ser. No. 723,767 filed Apr. 16, 1985, now abandoned.

BACKGROUND OF THE INVENTION

The present invention generally concerns the production of synthetic gas or fuel gas containing hydrogen and carbon monoxide which is formed by partially oxidizing a slurry of solid carbonaceous fuel and a carrier liquid admixed with a gas containing free oxygen in a hollow free-flowing reactor. More particularly, this invention concerns an improved burner nozzle for admixing the slurry and the oxyen-containing gas, and then introducing the admixture into a reactor.

Three basic processes have been developed for the gasification of carbonaceous materials. They are the fixed bed process, the fluidized bed process, and the suspension or entrained process. The efficiency of the entrained process, with which the present invention is concerned, is significantly affected by the degree of mixing of reactants prior to carrying out the partial oxidation reaction leading to gasification. Where a slurry of a finely divided carbonaceous fuel in a carrier liquid is admixed with an oxygen-containing gas, it is very important that the reactants are uniformly mixed and atomized into very fine droplets at the time they are vaporized and then ignited to form a gaseous product. Annular-type burner nozzles have been employed for introducing an admixture of slurry and oxygen-containing gas into a reactor. For example, annular-type burners are shown in U.S. Pat. Nos. 4,364,744 and 4,443,230. Problems that have been addressed with such burner nozzles include mixing to provide proper distribution of the fuel and oxygen in the admixture, atomization of the admixture, stability of burner nozzle operation, reduction of localized overheating in the reactor and burner nozzle, and reduction of mechanical wear of the burner nozzle. In addition to these problems, slurries containing a high concentration of divided solids also tend to plug or partially plug annular passageways as they are transported through the burner nozzles.

SUMMARY OF THE INVENTION

In general, the present invention provides an improved burner nozzle and a process for making a synthesis gas or fuel gas mixture containing hydrogen and carbon monoxide by the partial oxidation of a slurry of solid carbonaceous fuel in a liquid carrier admixed with a gas containing free oxygen, the partial oxidation occuring in a free-flowing hollow reactor. By means of the burner nozzle, the slurry and oxygen-containing gas are admixed, atomized and introduced into the reactor. The gas is produced in the reactor at a temperature of from about 1700° Fahrenheit to about 3500° Fahrenheit and a pressure from about atmospheric to about 3500 pounds per square inch. Processes and reactors for producing such a gas are generally illustrated and described in U.S. Pat. Nos. 2,716,598; 3,607,156; and 3,607,157. The raw gas produced also contains additional by-product gases such as nitrogen, carbon dioxide and hydrogen sulfide, as well as particulate matter, which usually requires additional processing to remove the same before final use of the product gas. An inorganic slag by-product may also be produced in the reactor along with the product gas.

In one aspect, the present invention is an improved process for making a gas mixture containing hydrogen and carbon monoxide by the partial oxidation of a slurry of solid carbonaceous fuel in a liquid carrier admixed with a gas containing free oxygen, the partial oxidation occuring in a free-flowing hollow reactor, the improvement comprising (a) passing a first gas stream containing free oxygen through a first, or central axial, passageway formed by a central conduit of a burner nozzle with an exit discharge velocity of from about 75 feet per second to about sonic velocity, the burner nozzle including spaced coaxial second and third conduits surrounding the central conduit and forming an annular second passageway between the central and second conduits and an annular third passageway between the second and third conduits, the first and third passageways being closed at their upstream ends and operatively connected to an inlet for a gas feedstream, the second passageway being interconnected at its upstream end with a distribution chamber which is, in turn, connected with an inlet for a slurry feedstream, the first, second and third passageways being open at their downstream discharge ports; (b) simultaneously passing a second gas stream containing free oxygen through the annular third passageway with an exit discharge velocity of from about 75 feet per second to about sonic velocity and a stream of the slurry through the annular second passageway with an exit discharge velocity from about 1 to about 50 feet per second; (c) impinging the stream of slurry on a converging surface of a nozzle diffuser, whereby the stream of slurry and the first and second gas streams are mixed, by impact of the slurry on the converging surface and by shearing action of the first and second gas streams, to produce a uniformly dispersed, atomized admixture of finely-divided, solid carbonaceous fuel, liquid carrier and gas containing free oxygen; (d) passing the admixture through an elongated exit orifice at an accelerated velocity of from about 100 feet per second to about sonic velocity to further atomize the admixture before it enters the reactor, the exit orifice being coaxial with the central conduit; and (e) reacting the admixture in the reactor to form the partially oxidized gas mixture containing hydrogen and carbon monoxide.

In a second aspect, the present invention is a burner nozzle for a free-flowing, hollow reactor used to make a gas mixture containing hydrogen and carbon monoxide by a process of partially oxidizing a slurry of solid carbonaceous fuel in a liquid carrier admixed with a gas containing free oxygen, the nozzle comprising (a) a central conduit forming a central passageway for transporting a gas stream containing free oxygen, (b) a spaced coaxial second conduit forming an annular second passageway between the central and second conduits for transporting a stream of slurry, (c) a spaced coaxial third conduit forming an annular third passageway between the second and third conduits for transporting a gas stream containing free oxygen, the first and third passageways being closed at their upstream ends and operatively connected to an inlet for a gas feedstream, the second passageway being interconnected at its upstream end with a distribution chamber which is, in turn, connected with an inlet for a slurry feestream, the first, second and third passageways being open at downstream discharge ports formed by the termination of the central, second, and third conduits, the distribution chamber having a cross-sectional area which is substantially larger than that of the annular second passageway thereby providing a pressure of the slurry stream which is substantially uniform throughout the area where the distribution chamger interconnects with the second passageway, (d) a nozzle diffuser interconnecting with the third passageway, disposed near the downstream end of the third conduit, and in a juxaposed position downstream from the discharge ports of the central and second passageways, the diffuser having a converging surface upon which the slurry stream exiting the discharge port of the second passageway impinges; and (e) an elongated exit orifice interconnected with the diffuser through which the admixture of slurry and gas containing free oxygen is transported at an accelerated velocity into the reactor, the exit orifice being coaxial with the central conduit.

In another aspect related to both the first and the second aspect, the burner nozzle includes spaced coaxial second and third conduits surrounding the central conduit and forming an annular second passageway between the central and second conduit and an annular third passageway between the second and third conduit, the second conduit having an elongated upstream conduit section interconnected with an elongated downstream conduit section thereby providing an upstream annular passageway segment and a downstream annular passageway segment, the upstream section having a diameter sufficiently large, in comparison to that of the downstream section, to provide the upstream segment with a cross-sectional area which is substantially greater than that of the downstream segment thereby providing a pressure on the slurry feedstream in the upstream segment which is substantially uniform throughout an annular area formed where the upstream and downstream segments interconnect, the first passageway being open at its upstream end and at its downstream discharge port, and the second and third passageways being closed at their upstream end, except where they are interconnected respectively with a slurry feedstream inlet and a gas feedstream inlet, and open at their downstream discharge ports.

The present invention also provides an improved plug resistant nozzle which can be used in other applications such as their use as spray nozzles during aireation of waste slug in waste disposed plants. The nozzle has been designed to provide an efficient and uniform admixture of a slurry having a high concentration of finely divided solids with a gas while, at the same time, reducing the tendency of such a concentrated slurry to partially or completely plug annular passageways in the nozzle.

These and other aspects of the invention will be apparent to those skilled in the art from the foregoing description and from the more detailed description which follows.

DESCRIPTION OF THE PREFERRED EMBODIMENTS

The following description illustrates the manner in which the principles of the present invention are applied, but it is not to be construed in any sense as limiting the scope of the invention.

Figure 1:
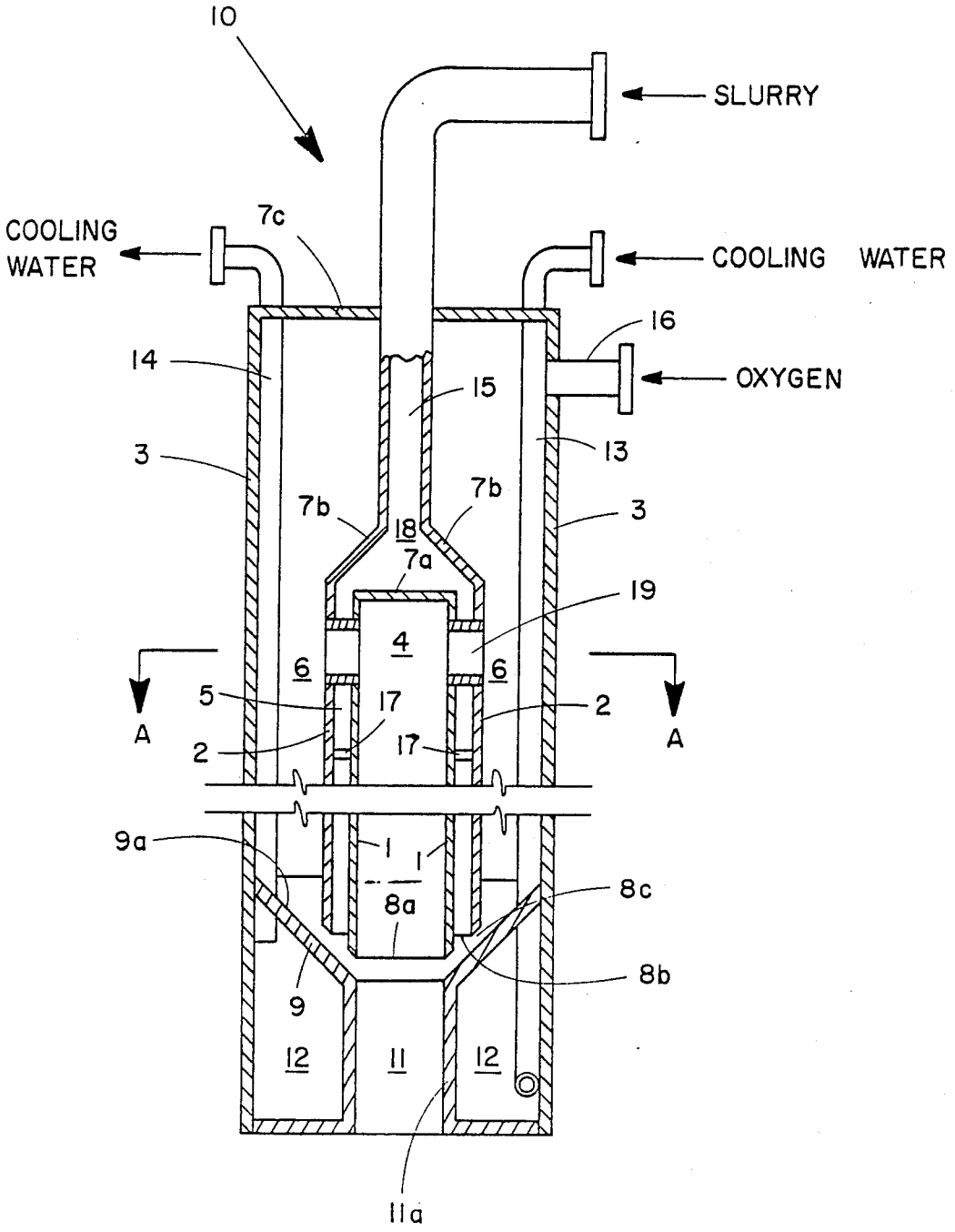
FIG. 1 is a partial longitudinal cross-section illustrating a burner nozzle made in accordance with the principles of the present invention.
Figure 2:
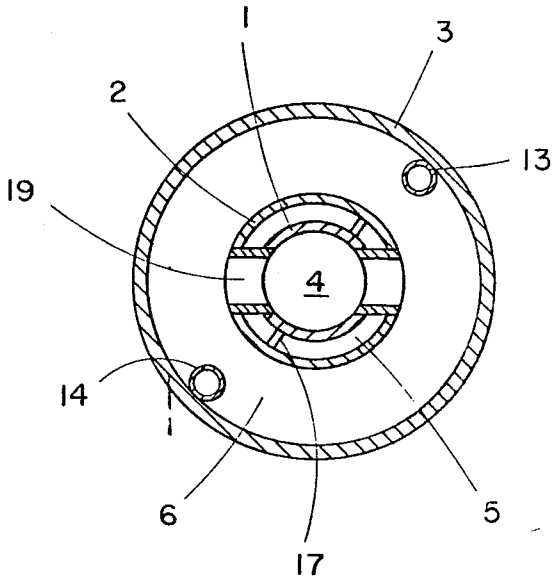
FIG. 2 is a transverse cross-section taken at line A—A of FIG. 1 illustrating an embodiment of the burner nozzle.

More specifically, referring to FIGS. 1 and 2, burner nozzle 10 is illustrated. Burner nozzle 10 includes a central conduit 1 forming a passageway 4; a coaxial second conduit 2 forming an annular passageway 5; and a coaxial third conduit 3 forming an annular passageway 6. Passageway 5 is held in a spaced relationship with passageways 4 and 6 by spacers 17. Spacers 17 should be kept to a minimum to avoid unnecessary disruption of a slurry stream flow in passageway 5. The terms "stream" and "feedstream" are used interchangeably herein. Passageways 4 and 6 are respectively closed at their upstream ends by walls **7*a* and 7*c*. Walls 7*b* at the upstream end of passageway 5 converge to form a distribution chamber 18 and interconnect with slurry inlet 15. Gas feedstream inlet 16 is operatively connected to passageway 6. Distribution chamber 18 is provided to uniformly transport the slurry feedstream (not shown) into the annular passageway 5. Passageways 4, 5 and 6 have discharge ports respectively designated as 8*a*, 8*b*, and 8*c* at their downstream ends formed by the termination of conduits 1, 2 and 3. A tube 19 is used to provide open communication between passageways 4 and 6** for the transport of the gas feedstream.

Burner nozzle 10 also includes a nozzle diffuser 9 having a converging surface **9*a* upon which the slurry stream (not shown) passing through passageway 5 impinges, and an elongated exit orifice 11 to transport the admixture of slurry and oxygen-containing gas into a reactor (not shown) at an accelerated velocity. In this embodiment the diffuser 9 is a continuous converging extension of conduit 3 and is operatively connected to exit orifice 11 at its upstream end. As a result of the harsh environment to which the diffuser 9 is subjected, i.e., high temperatures, chemicals attack, and mechanical wear, it is an advantage, if not a necessity, to construct the diffuser 9 from a material such as tungsten carbide or silicon carbide, whereas the remainder of the nozzle 10 can be constructed of a metal such as stainless steel. Accordingly, diffuser 9 may also be an insert which is fastened to conduit 3, and interconnected with, passageway 6 rather than being a continuation of conduit 3. It is also an advantage to provide a water jacket 12 having a water inlet 13 and outlet 14 to cool the diffuser 9 and walls 11*a* of the orifice 11. The orifice 11 of nozzle 10 has a cylindrical design, but may also have diverging or converging walls 11*a* (not shown). Also, although not a critical design requirement, the length of the orifice 11** is beneficially longer than its diameter to provide for additional time in a zone of high shear for the slurry/gas mixture, and for a high degree of atomization of the admixture transported into the reactor.

Figure 4:
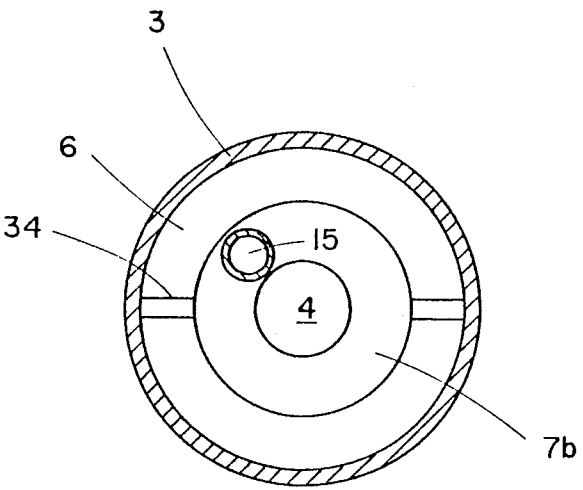
FIG. 4 is a transverse cross-section taken at line B—B of FIG. 3 illustrating an embodiment of the burner nozzle.
Figure 3:
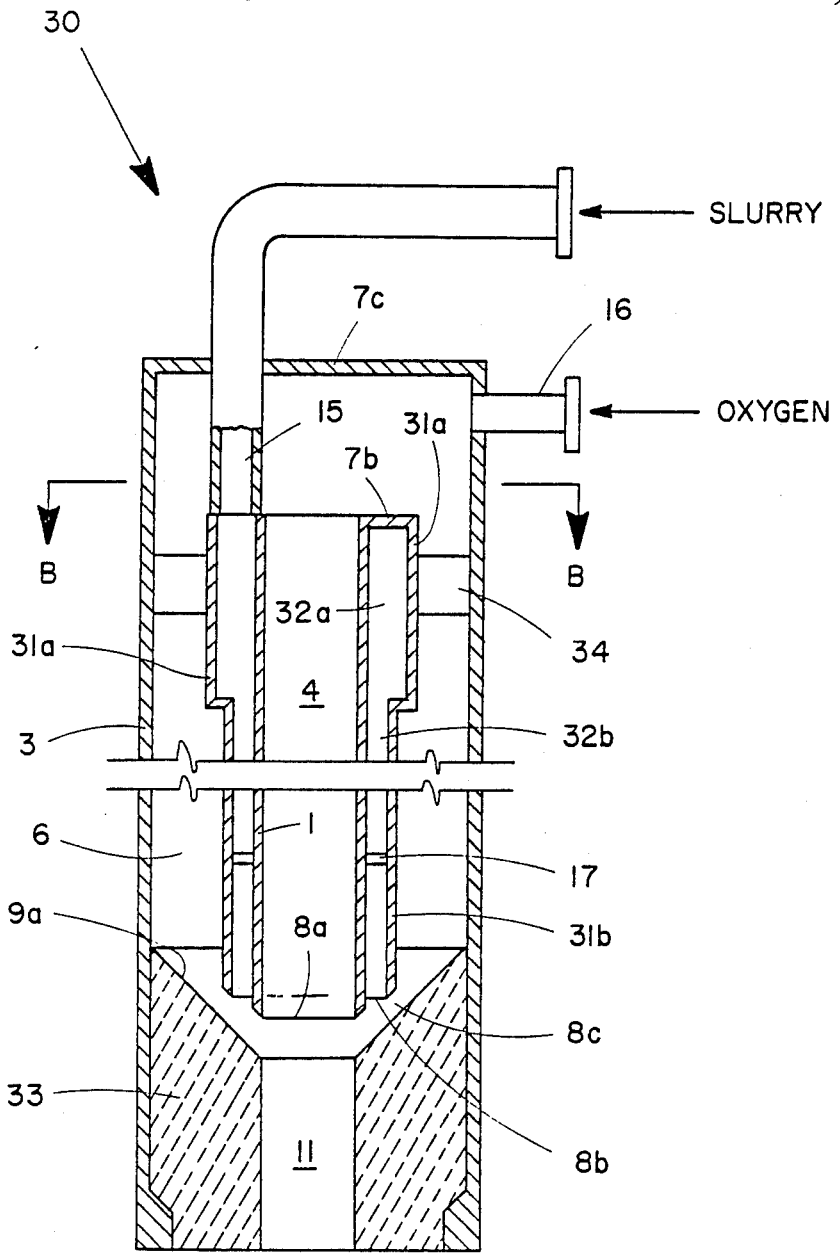
FIG. 3 is a partial longitudinal cross-section illustrating another, preferred burner nozzle made in accordance with the principles of the present invention.

Referring to FIGS. 3 and 4, another embodiment of the present invention is illustrated as burner nozzle 30. Elements of burner nozzle 30 shown in FIGS. 3 and 4 which are like those shown in FIGS. 1 and 2 for burner nozzle 10 have the same reference numerals. Burner nozzle 30 includes modification of both the central conduit and second coaxial conduit, thus changing the central gas passageway and the slurry passageway, and changes in the nozzle diffuser and exit orifice. Thus, burner nozzle 30 includes interconnected upstream annular conduit section 31*a* and downstream annular conduit section 31*b* which form an annular slurry passageway with a first, or upstream, annular segment 32*a* and a second, or downstream, annular segment 32*b*. The upstream section 31*a* has a diameter sufficiently large, in comparison to that of downstream section 31*b*, to provide segment 32*a* with a cross-sectional area which is substantially larger than that of segment 32*b*. The slurry feedstream from inlet 15 is fed directly into segment 32*a*, thereby eliminating the need for gas tube 19 of nozzle 10 and allowing direct flow of the gas feedstream into passageways 4 and 6, passageway 4 of nozzle 30 being open at its upstream end rather than closed as in nozzle 10. Segment 32*a* is closed at its upstream end except for where it interconnects with slurry feedstream inlet 15. This provides much less disruption of the slurry flow in passageway segments 32*a* and 32*b* than might be experienced in passageway 5 of nozzle 10. If necessary, fasteners 34 may be included to overcome any structural weakness.

Burner nozzle 30 also beneficially includes a ceramic nozzle diffuser 33 having a converging surface 9*a* upon which the slurry stream from passageway segment 32*b* impinges and an elongated exit orifice 11. Diffuser 33 is held in place by conduit 3. Alternatively, fastening means may be used to secure diffuser 33 in a fixed position relative to conduit 3 and discharge ports 8*a*, 8*b* and 8*c*. There are many well known ceramic materials that can be used to make the diffuser 33. One such material is a dense-phase alumina refractory. Use of a ceramic material not only provides the diffusion surface 9*a*, but also insulates the nozzle from the heat produced in the reactor (not shown).

As previously noted, handling highly concentrated slurries of finely divided solids in annular nozzles such as burner nozzles 10 and 30 may result in a problem of the finely-divided solids separating from the liquid carrier and plugging slurry passageways. To overcome the possibility of this occuring, and to provide uniform flow across the entire cross-section of the annular flow passageway, nozzle 10 includes the distribution chamber 18 and nozzle 30 includes the combined segments 32*a* and 32*b* that form the slurry passageway. In both nozzles 10 and 30, the upstream chamber or segment of the passageway for the slurry stream has a substantially larger cross-sectional area than the downstream segment. As specific example, a nozzle designed like nozzle 30 was constructed of metal pipe wherein the central gas stream passageway had about a three inch diameter and 16 inch length, and the first segment of the slurry passageway had an annular cross-sectional thickness of about one and one-half inches around the central passageway and a 4 inch length, and the second segment of the slurry passageway had an annular cross-sectional thickness of about one quarter of an inch and a 12 inch length.

The slurry stream in the larger upstream chamber or segment provides a substantially uniform pressure throughout the annular area at the point where distribution chamber 18 interconnects with annular passageway 5 in nozzle 10 or at the point where upstream annular segment 32*a* interconnects with downstream annular segment 32*b* of the annular slurry passageway of nozzle 30, thus substantially reducing flow variations around the annular flowpath of the slurry stream. It has been also found that this uniform annular pressure at the point of interconnection can be substantially maintained by designing distribution chamber 18 of nozzle 10 or upstream annular segment 32*a* of nozzle 30, so that the pressure drop is less than or equal to about 20 percent of the pressure drop that occurs, respectively, in annular passageway 5 of nozzle 10 or downstream annular segment 32*b* of nozzle 30.

During operation of the burner nozzle, a gas feedstream and slurry feedstream are introduced into upstream inlets. The gas feedstream is split and passes through the central axial passageway and through the annular third passageway while the slurry feedstream simultaneously passes through the second passageway, thereby enveloping the annular slurry stream between a central axial stream of oxygen-containing gas and an outer annular stream of the same gas. The slurry stream and gas streams are discharged through the discharge parts of their respective passageways and the slurry stream is then impinged on a converging surface of the nozzle diffuser, whereby the slurry stream and gas streams are mixed by the impact of the slurry on the converging surface of the diffuser and by the shearing action of the gas streams to produce a uniformly dispersed, atomized admixture of finely-divided solid carbonaceous fuel, liquid carrier and gas containing free oxygen. This admixture is then passed through the elongated exit orifice at an accelerated velocity to further atomize the admixture before it enters the reactor.

In order to produce the desired uniformity of dispersion and atomization of the admixture of slurry and gas, it has been determined that velocities of the gas and slurry streams through the various passageways should be maintained within the following preferred ranges. The gas stream passing through the central axial passageway should have an exit discharge velocity from about 75 feet per second to about sonic velocity. The gas stream passing through the outer annular passageway (passageway 6 in FIGS. 1–4) should have an exit discharge velocity of from about 75 feet per second to about sonic velocity. The slurry stream passing through the second or middle annular passageway (passageway 5 in FIG. 1 and passageway 32*b* in FIG. 3) should have an exit discharge velocity from about 1 to about 50 feet per second. The velocity of the combined admixture of slurry and gas through the elongated exit orifice (reference numeral 11 in FIGS. 1 and 3) of nozzles representative of the present invention and into the reactor should be from about 100 feet per second to about sonic velocity.

While certain representative embodiments and details have been shown for the purpose of illustrating the present invention, it will be apparent to those skilled in the art that various changes and modifications can be made therein without departing from the spirit and scope of the invention.

What is claimed is:

1. A burner nozzle for a free flowing, hollow reactor used to make a gas mixture containing hydrogen and carbon monoxide by a process of partially oxidizing a slurry of solid carbonaceous fuel in a liquid carrier admixed with a gas containing free oxygen, the nozzle consisting essentially of (a) a central conduit forming a central passageway for transporting a gas stream containing free oxygen, (b) a spaced coaxial second conduit forming an annular second passageway between the central and second conduits for transporting a stream of slurry, (c) a spaced coaxial third conduit forming an annular third passageway between the second and third conduits for transporting a gas stream containing free oxygen, the first and third passageways being closed at their upstream ends and operatively connected to an inlet for a gas feedstream, the second passageway being interconnected at its upstream end with a distribution chamber which is, in turn, connected with an inlet for a slurry feedstream, the first and second passageways being open at downstream discharge ports formed by the termination of the central and second conduits, the distribution chamber having a cross-sectional area which is substantially larger than that of the annular second passageway thereby providing a pressure of the slurry stream which is substantially uniform throughout the area where the distribution chamber interconnects with the second passageway, (d) a nozzle diffuser interconnecting with the end of the third passageway forming a discharge port of the third passageway, and having a continuously converging section which extends inwardly to a point at which an extension of the central conduit would intersect with the converging section, and (e) a cylindrical acceleration conduit interconnecting with the downstream end of the continuously converging section of said diffuser, being coaxial with the central conduit and terminating in a discharge orifice.

2. The burner nozzle of claim 1 wherein the diffuser is a separate plug held in place by the third conduit, the discharge orifice extending through the plug.

3. A burner nozzle for a free flowing hollow reactor used to make a gas mixture containing hydrogen and carbon monoxide by a process of partially oxidizing a slurry of solid carbonaceous fuel in a liquid carrier admixed with a gas containing free oxygen, the nozzle consisting essentially of (a) a central conduit forming a central passageway for transporting a gas stream containing free oxygen, (b) a spaced coaxial second conduit forming an annular second passageway between the central and second conduit for transporting a feedstream of slurry, the second conduit having an elongated upstream conduit section interconnected with an elongated downstream conduit section thereby providing an upstream annular passageway segment and a downstream annular passageway segment, the upstream section having a diameter sufficiently large, in comparison to that of the downstream section, to provide the upstream segment with a cross-sectional area which is substantially greater than that of the downstream segment thereby providing a pressure on the slurry feedstream in the upstream segment which is substantially uniform throughout an annular area formed where the upstream and downstream segments interconnect, (c) a spaced coaxial third conduit forming an annular third passageway between the second and third conduits for transporting a gas stream containing free oxygen, the first passageway being open at its upstream end and at its downstream discharge port, and the second and third passageways being closed at their upstream end, except where they are interconnected respectively with a slurry feedstream inlet and a gas feedstream inlet, and open at their downstream discharge ports, (d) a nozzle diffuser interconnecting with the end of the third passageway forming the discharge port of the third passageway stream exiting the discharge port of the second passageway having a continuously converging section which extends inwardly to a point at which an extension of the central conduit would intersect with the converging section, and (e) a cylindrical acceleration conduit interconnecting with the downstream end of the continuously converging section of said diffuser, being coaxial with the central conduit and terminating in a discharge orifice.

4. The burner nozzle of claim 3 wherein the diffuser is a separate plug held in place by the third conduit with the discharge orifice extending through the plug.

5. An improved plug resistant nozzle for admixing a slurry having a high concentration of a finely divided solid in a carrier liquid with a gas stream consisting essentially of (a) a central conduit forming a central passageway for transporting a gas stream containing free oxygen, (b) a second spaced coaxial conduit forming an annular second passageway between the central and second conduits for transporting a stream of slurry, (c) a third spaced coaxial conduit forming an annular third passageway between the second and third conduits for transporting a gas stream containing free oxygen, the first and third passageways being closed at their upstream ends and operatively connected to an inlet for a gas feedstream, the second passageway being interconnected at its upstream end with a distribution chamber which is, in turn, connected with an inlet for a slurry feedstream, the first and second passageways being open at downstream discharge ports formed by the termination of the central and second conduits, the distribution chamber having a cross-sectional area which is substantially larger than that of the annular second passageway thereby providing a pressure of the slurry stream which is substantially uniform throughout the area where the distribution chamber interconnects with the second passageway, (d) a nozzle diffuser interconnecting with the end of the third passageway forming a discharge port of the third passageway, and having a continuously converging section which extends inwardly to a point at which an extension of the central conduit would intersect with the converging section, and (e) a cylindrical acceleration conduit interconnecting with the downstream end of the continuously converging section of said diffuser, being coaxial with the central conduit and terminating in a discharge orifice.

6. An improved plug resistant nozzle for admixing a slurry having a high concentration of a finely divided solid in a carrier liquid with a gas stream consisting essentially of (a) a central conduit forming a central passageway for transporting a gas stream containing free oxygen, (b) a second spaced coaxial conduit forming an annular second passageway between the central and second conduits for transporting a stream of slurry, the second conduit having an elongated upstream conduit section interconnected with an elongated downstream conduit section thereby providing an upstream annular passageway segment and a downstream annular passageway segment, the upstream section having a diameter sufficiently large, in comparison to that of the downstream section, to provide the upstream segment with a cross-sectional area which is substantially greater than that of the downstream segment thereby providing a pressure on the slurry feedstream in the upstream segment which is substantially uniform throughout an annular area formed where the upstream and downstream segments interconnect, (c) a spaced coaxial third conduit forming an annular third passageway between the second and third conduits for transporting a gas stream containing free oxygen, the first passageway being open at its upstream end and at its downstream discharge port, and the second and third passageways being closed at their upstream end, except where they are interconnected respectively with a slurry feedstream inlet and a gas feedstream inlet, and open at their downstream discharge ports, (d) a nozzle diffuser interconnecting with the end of the third 4 forming the discharge port of the third passageway and having a continuously converging section which extends inwardly to a point at which an extension of the central conduit would intersect with the converging section, and (e) a cylindrical acceleration conduit interconnecting with the downstream end of the continuously converging section of said diffuser, being coaxial with the central conduit and terminating in a discharge orifice.

* * * * *

UNITED STATES PATENT AND TRADEMARK OFFICE

CERTIFICATE OF CORRECTION

PATENT NO. : 4,857,076

DATED : August 15, 1989

INVENTOR(S) : Stanley R. Pearson, Douglas D. Merrick, Charles W. Lipp, and William P. White It is certified that error appears in the above-identified patent and that said Letters Patent is hereby corrected as shown below:

Column 3, line 6, "chamger" should read -- chamber --; column 3, line 46, "aireation" should read -- aeration --. Column 4, line 44, "chemicals" should read -- chemical --. Column 5, lines 49-50, "As specific" should read -- As a specific --. In the Claims: Claim 3, lines 63-64, delete "stream exiting the discharge port of the second passageway" and add -- and -- between "passageway" and "having". Col. 9, line 3, delete "4" and add therefor -- passageway --.

Signed and Sealed this

Ninth Day of October, 1990

*Attest:*

HARRY F. MANBECK, JR.

*Attesting Officer*

*Commissioner of Patents and Trademarks*